US007558690B2

(12) United States Patent
Curtius et al.

(10) Patent No.: US 7,558,690 B2
(45) Date of Patent: Jul. 7, 2009

(54) METHOD FOR CALIBRATING SENSORS

(75) Inventors: Georg Curtius, Dillingen (DE); Michael Fauth, Pleinfeld (DE); Reinhard Hering, Holzheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 127 days.

(21) Appl. No.: 11/658,059

(22) PCT Filed: Jul. 22, 2005

(86) PCT No.: PCT/EP2005/053589

§ 371 (c)(1),
(2), (4) Date: Jan. 19, 2007

(87) PCT Pub. No.: WO2006/010744

PCT Pub. Date: Feb. 2, 2006

(65) Prior Publication Data

US 2008/0040063 A1 Feb. 14, 2008

(30) Foreign Application Priority Data

Jul. 23, 2004 (DE) ..... 10 2004 035 848

(51) Int. Cl.
*G06F 19/00* (2006.01)

(52) U.S. Cl. ..... 702/104; 8/158; 702/85; 702/93

(58) Field of Classification Search ..... 702/84, 702/104, 118, 167, 185, 189, 190, 85, 93; 8/158

See application file for complete search history.

(56) References Cited

U.S. PATENT DOCUMENTS 5,560,060 A * 10/1996 Dausch et al. ..... 8/158

FOREIGN PATENT DOCUMENTS

| | | |
|---|---|---|
| EP | 0 862 892 | 9/1998 |
| EP | 1 238 623 | 9/2002 |
| JP | 4-279136 | 10/1992 |

OTHER PUBLICATIONS

EP 1238623 (Sep. 11, 2002), Beier Dominic, English translation*
International Search Report PCT/EP2005/053589.

* cited by examiner

*Primary Examiner*—John H Le
(74) *Attorney, Agent, or Firm*—James E. Howard

(57) ABSTRACT

A method for calibrating a sensor, particularly a turbidity sensor in a domestic appliance, such as a dishwasher or washing machine, with the aid of reference values, including the determination of measuring values, with at least one measured value selected using probability calculus that is no longer taken into account when determining the reference values.

17 Claims, 4 Drawing Sheets

METHOD FOR CALIBRATING SENSORS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a method for calibrating sensors, in particular turbidity sensors in domestic appliances, and a relevant domestic appliance for carrying out the method.

2. Description of Related Art

In domestic appliances, e.g. dishwashers or machine machines, turbidity sensors are used to determine the degree of contamination of the cleaning fluid, e.g. washing solution or washing liquid. Values of the degree of contamination determined by the turbidity sensor are used for further control of the cleaning program of the domestic appliance. In a dishwasher the cleaning program consists, for example, of the partial program steps "pre-wash", "clean", "intermediate rinse", "clear rinse" and "dry". Frequently a plurality of intermediate rinsing steps are carried out within the partial program step "intermediate rinse". By using the values of the degree of contamination determined by the turbidity sensor, the dishwasher controller can discontinue the execution of further intermediate rinsing steps when the degree of contamination falls below a certain value. Thus, a considerable saving of water and energy can be achieved with the same cleaning results. In addition, if the degree of contamination is low during the "pre-wash", the washing liquid from the "pre-wash" can be used for the "clean" partial program step.

The turbidity is generally measured by passing light through the cleaning liquid. However, other physical measurement methods, e.g. using sound, are also feasible. When using the physical principle of passing light through the cleaning liquid, where particles pressed as a suspension in the cleaning liquid retain a part of the light, a transmitting and receiving device for the light is required. The transmitting device, for example, comprises a lamp or a light-emitting diode and the receiving device, for example, comprises a phototransistor. However, the transmitting and receiving devices are subjected to changes from usage and ageing. In addition, in some cases considerable deposits can occur on the optical devices. Temporary impurities on the transmitting and receiving devices can lead to appreciable errors in the measurements. In the course of time, this results in successively increasing errors in the measurements of the turbidity of the cleaning liquid. This gives rise to errors in the control of the domestic appliance.

Known from EP 0 862 892 B1 is a domestic appliance with a measuring device for determining the degree of contamination of a cleaning liquid. In order to prevent incorrect measurements, an adjusting measurement is carried in a cleaning program in a preceding cleaning program in which the measuring device is used to determine the degree of contamination of the cleaning liquid, this preferably being carried out in a program part with uncontaminated washing liquid, e.g. clear rinse. The measured value for the adjustment of the measuring device in the following cleaning program can be stored in a non-volatile memory. A disadvantage here is that if little intermediate rinsing is carried out or this is faded out, the rinsing solution can contain appreciable impurities during the clear rinsing so that the measurement results can be falsified. Furthermore, only one adjusting measurement is made so that in the event of randomly occurring severe contamination, e.g. caused by localized deposits on the transmitting device, measured values for the adjustment of the measuring device with considerable errors are the consequence.

A method for adjusting a turbidity sensor is known from DE 101 11 006 A1. Several calibration value measurements are made at different times within a wash program and stored in a first memory table, calibration value measurements being made in several wash programs. From these calibration value measurements, the calibration measured value having the lowest degree of contamination is determined by selection for each wash program and is written in a second memory table. The average is calculated from the stored selected calibration measured values of the second memory table and this forms the reference value for the measurement using the turbidity sensor.

A disadvantage is that only a relatively small number of calibration measurements forms the basis for determining the reference value which is merely the average of a plurality of individual measurements within a wash program. Consequently, sources of error which occur in several wash programs or only within an entire wash program, e.g. contamination on the optics of the transmitting device, cannot be identified. As a result of determining the reference value by merely averaging from all the calibration measured values for each wash program, these calibration measured values frequently loaded with considerable errors are disadvantageously included in the averaging. For example, if contamination occurs in the three preceding wash programs and this contamination is eliminated again in a following wash program, the measurement is nevertheless made using the reference value from the average of the frequently defective individual measurements, whereby this error is propagated until all the calibration measurements forming the basis for the reference value are not longer affected by errors caused by temporary impurities.

BRIEF SUMMARY OF THE INVENTION

It is thus the object of the present invention to provide a method and a relevant domestic appliance for carrying out the method which allows sensors, e.g. turbidity sensors, to be calibrated reliably in a simple manner under all operating conditions of a domestic appliance, in particular, in the case of temporary contamination.

This object is achieved by the method according to the invention for calibrating sensors and a domestic appliance for carrying out the method as set forth in the independent claims. Advantageous further developments of the invention are characterized by the dependent claims.

In the method according to the invention for calibrating a sensor, in particular a turbidity sensor in a domestic appliance, e.g. a dishwasher or a washing machine, with the aid of reference values, the following steps are carried out:

determining at least two measured values in at least one cleaning program sequence, selecting at least one measured value by statistical methods or probability calculus which is no longer taken into account in the following step and determining at least one possible reference value for calibrating the sensor from the non-selected measured values and selecting an optimal reference value from the least one possible reference value if more than two possible reference values have been determined.

More appropriately, the selection of the at least one measured value by statistical methods or probability calculus which is no longer taken into account in the following step is made in each case from a series of measured values which are measured at the same times within a washing program sequence. Thus, measured values which were measured at the same times within a wash program sequence are selected so that these are similar to one another and suitable for further selection methods or calculations.

Preferably, the following steps are carried out for selecting at least one measured value:

determining the arithmetic mean for the measured values according to the formula $$d_a = \frac{m_a^1 + m_a^2 + m_a^3 + m_a^4 + \ldots + m_a^s}{s},$$

determining the mean square error using the formula $$\sigma_a^2 = \frac{(m_1^1 - d_a)^2 + (m_1^2 - d_a)^2 + \ldots + (m_1^s - d_a)^2}{s},$$

determining the probable limits of the possible reference value wherein these lie within $$d_a \pm \frac{0{,}6746}{\sqrt{s}}$$

and selecting the measured values which lie outside these limits.

In a further variant, if no measured value lies outside the probable limits of the possible reference value the interval of the probable limits of the possible reference value is set as smaller so that at least one measured value lies outside and this at least one measured value is selected. By this means, at least one measured value is always selected. The method can thus be adapted to changing relationships.

In a further variant, empirical values preferably predefined ex works are additionally used to determine the probable limits of the possible reference value, these being automatically adapted to changing relationships in the process sequence. The method can thus be optimally applied in a new domestic appliance and is automatically adapted to changing relationships e.g. impurities so that the method according to the invention is "learnable".

Preferably the at least one possible reference value for the calibration of the sensor is determined from the remaining non-selected measured values by averaging. By this means, the possible reference values for the series of measured values can be simply determined at each time for the measured values and any incorrect measurements which may still be present only have a little influence as a result of the averaging.

More appropriately, the at least one possible reference value for the calibration of the sensor is determined from the remaining non-selected measured values by selecting a measured value by means of statistical methods or probability calculus. This can eliminate errors resulting from individual incorrect measurements which may still be present because only one signal measured value is selected.

In a further variant, the measured value with the highest probability density within the non-selected measured values is selected. This can eliminate possible errors compared with averaging which is based on measured values which are possibly defective.

Preferably that measured value is selected as a possible reference value that lies closest to the arithmetic mean of the non-selected measured value by the following steps:

determining the arithmetic mean of the non-selected measured values, determining the magnitude of the difference between the arithmetic mean and the respective measured value, wherein that measured value is selected for which the magnitude of the difference is smallest.

In an additional variant, from the possible reference values the most optimum is selected as the reference value for the calibration of the sensor, i.e. in general the reference value having the lowest degree of contamination.

In a further method according to the invention for calibrating a sensor, in particular a turbidity sensor in a domestic appliance, e.g. a dishwasher or a washing machine, with the aid of reference values the following steps are carried out:

determining at least two measured values in at least one cleaning program sequence, determining at least one possible reference value from the measured values by selecting a measured value using methods of probability calculus or statistics and selecting an optimal reference value from the possible reference values if more than one possible reference value has been determined.

The method step of selecting at least one measured value is thus dispensed with so that a simpler method is provided.

More appropriately, the selection of the at least one measured value is made by statistical methods or probability calculus in each case from a series of measured values which were measured at the same times within a washing program sequence. Thus, the possible reference value is selected from measured values which are comparable to one another.

Preferably, that measured value is selected as a reference value that lies closest to the arithmetic mean of the non-selected measured values by the following steps:

determining the arithmetic mean of the non-selected measured values, determining the magnitude of the difference between the arithmetic mean and the measured value, wherein that measured value is selected for which the magnitude of the difference between the arithmetic mean and the average is smallest.

Preferably from the reference values, the most optimum is selected as the reference value for the calibration of the sensor, i.e. in general the reference value having the lowest degree of contamination.

In a domestic appliance according to the invention, a method according to one or more of the preceding claims can be implemented.

A computer program with program code means to carry out all the steps of a method according to one of the steps described above, if the computer program is carried out on a computer program or a corresponding processing unit, is also part of the invention.

A computer program product with program code means which are stored on a computer-readable data carrier to carry out a method according to one of the above steps, if the computer program is carried out on a computer program or a corresponding processing unit, is also part of the invention.

The invention is explained hereinafter with reference to an exemplary embodiment with the aid of the following drawings as an example: in the drawings:

BRIEF DESCRIPTION OF THE SEVERAL VIEWS OF THE DRAWING(S)

DETAILED DESCRIPTION OF THE INVENTION

Figure 1:
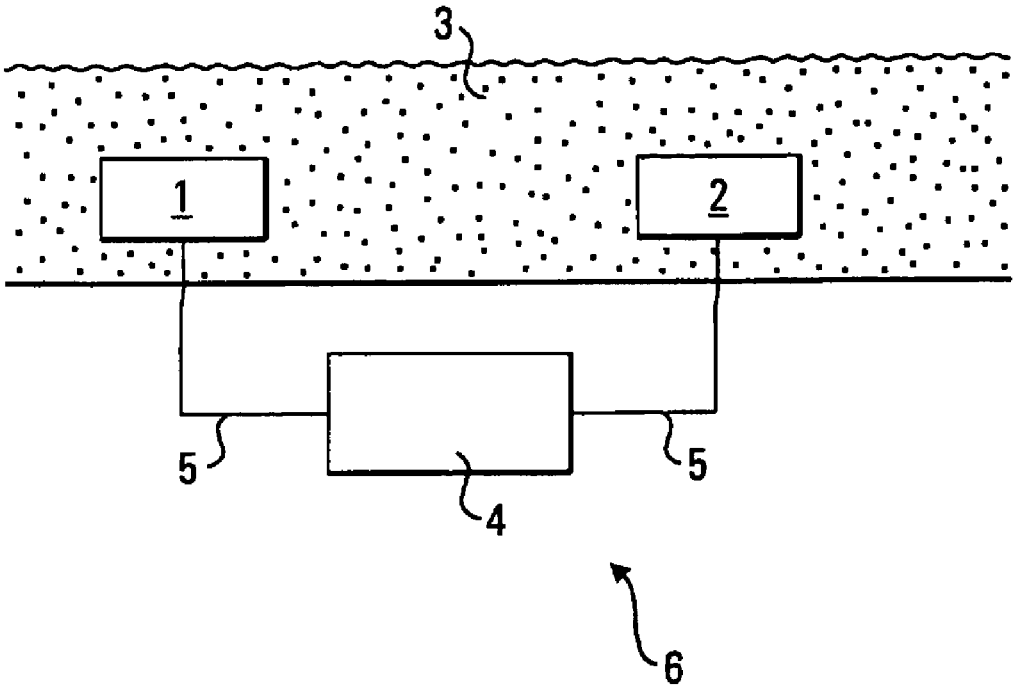
FIG. 1 is a schematic diagram of a turbidity sensor.

FIG. 1 is a schematic diagram showing a turbidity sensor 6. This has a transmitting device 1 in the form of a lamp which preferably emits visible light. The transmitting device 1 can also emit electromagnetic waves from other arbitrary frequency ranges, e.g. infrared light. In a receiving device 2 in the form of a photocell, the light incident thereon is converted into current. The washing solution 3 containing impurities is located between the transmitting device 1 and the receiving device 2. A control and evaluation unit 4 supplies the transmitted device 1 with current and evaluates the current delivered by the receiving device 2. The transmitting device 1 and the receiving device 2 are connected to the control and evaluation unit 4 via electrical leads 5. The control and evaluation unit 4 can also be part of the controller of a dishwasher according to the invention, i.e. a separate control and evaluation unit 4 is not required for the turbidity sensor 6. The degree of contamination of the washing solution 3 is determined on the basis of the change in the light incident on the receiving unit 2 when the power supply for the transmitting device 1 is preferably constant. The smaller the current delivered by the receiving device 2, the higher is the degree of contamination. The turbidity sensor 6 can be built into the dishwasher according to the invention, e.g. in the washing container or in a line for washing solution. The further program sequence is controlled by the controller of the dishwasher according to the invention using this value of the degree of contamination. For example, when the degree of contamination falls below a certain level, the implementation of further intermediate rinsing steps is interrupted or the washing solution is not changed between pre-wash and clean.

Figure 2:
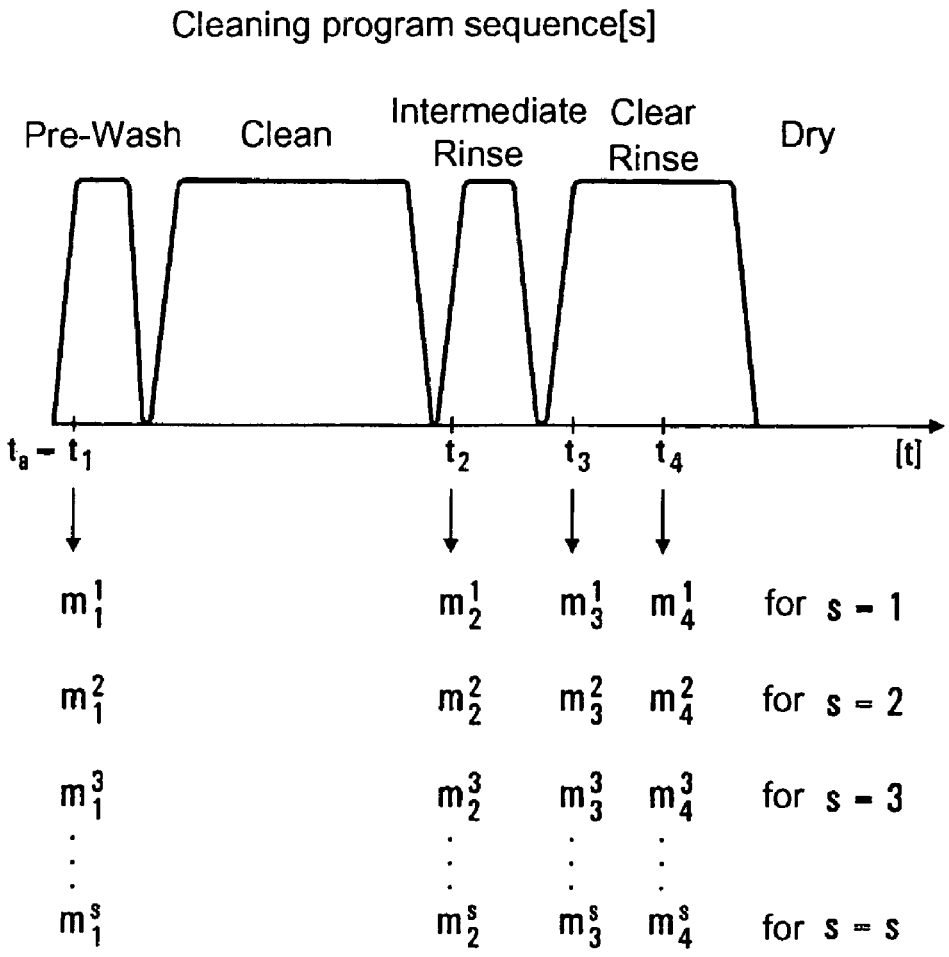
FIG. 2 is a schematic flow diagram for a wash program in a dishwasher.

FIG. 2 shows a conventional program sequence s of a dishwasher. The time is plotted on the abscissa and the amount of washing solution in the dishwasher is plotted on the ordinate. The wash program sequence consists of the part program steps "pre-wash", "clean", "intermediate rinse", "clear rinse" and "dry". The measured value or values are $m_1^1$, $m_2^1$, $m_3^1$ and $m_4^1$ ($m_a^s$ where a is the time $t_a$ of the measurements within a wash program sequence and s is the number of measurements of a measured value $m_a^s$ at the same time $t_a$ in each case in the wash program sequences s=1, 2, 3 to s). The measured values $m_1^1$, $m_2^1$, $m_3^1$ and $m_4^1$ are each determined at the times $t_a=t_1$, $t_2$, $t_3$ and $t_4$ to calibrate the turbidity sensor 6. Only one measured value can be measured within a wash program sequence s, preferably in the "clear rinse" part program step or a plurality of reference values can be measured within the wash program, wherein a plurality of measured values, e.g. $m_3^1$, $m_4^1$ can be measured within one part program step, e.g. "clear rinse" to calibrate the turbidity sensor 6. The measured values $m_a^s$ at a time $t_a$ are arranged one below the other as a measurement series in columns in FIG. 2. Within one wash program sequence, the measured values are each measured at the same time. According to FIG. 2, four measurements were carried out at different times $t_a=t_1$, $t_2$, $t_3$ and $t_4$ per wash program sequence so that four columns of measurement series are present in FIG. 2. For different wash programs, e.g. delicate 50°, intensive 70° or automatic 55°-65° with different durations of the individual part program steps, the measurement is made at the same time in each case after the beginning or before the end of a part program step. In addition, the method can be refined in that a separate measurement series is stored for each different wash program with at least one measurement. In this procedure, the number of measurement series does not correspond to the number of measuring times $t_a$ but the sum of the individual measuring times $t_a$ summed to each individual wash program.

Figure 3:
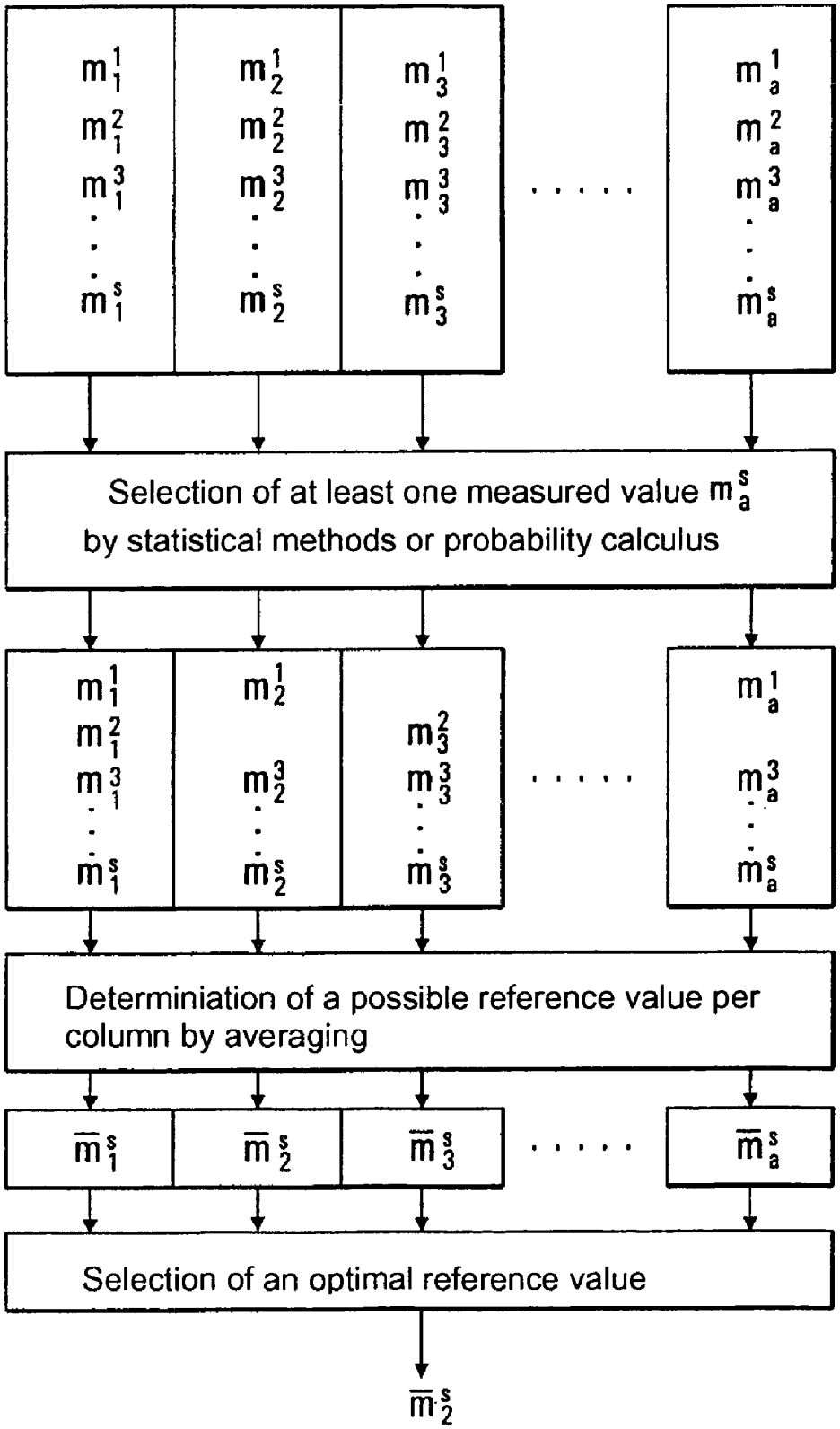
FIG. 3 is a flow diagram according to the invention for determining a reference value for calibrating the turbidity sensor and FIG. 4 is a further flow diagram according to the invention for determining the reference value for calibrating the turbidity sensor.

FIG. 3 shows a flow diagram according to the invention for determining the reference value $m_a^s$. The measured values $m_a^s$ are shown in the uppermost section. One column shows the measured values $m_a^s$ in each case from the wash program sequences s=1 to s at the same time $t_a$ in each case. The measured values $m_a^s$ are preferably determined sequentially on the wash program sequences s=1 to s preceding the actual wash program sequence s+1 in each case. A different procedure is also possible in this case, e.g. the measured values $m_a^s$ are only determined from wash program sequences s having a low loading provided that, for example, corresponding load sensors are available. The number of measuring times $t_a$ thus corresponds to the number of columns. The first column, for example gives the measured values $m_{a=1}^{s=1\ to\ s}$ of the wash program sequences s=1 to s at time $t_1$, wherein measured values $m_a^s$ from different wash programs are also contained herein.

An operation unit is shown below these columns. In this uppermost operation unit, at least one measured value $m_a^s$ which is no longer taken into account in the further steps is selected by preferably statistical methods. An example of such a statistical method is described further below. Apart from statistical methods, other methods are also considered, e.g. methods of probability calculus. Below the operation unit the measured values $m_a^s$ are again arranged in columns from the wash sequences, one measured values $m_a^s$ being selected in each case. For example, in the second column from the left, the measured value $m_2^2$ was selected from the wash sequence s=2.

An operation unit is shown below these columns in FIG. 3. In the operation unit, the mean of the remaining measured values $m_a^s$ of one column is formed, i.e. $\overline{m_a^s}$ is determined as a possible reference measured value. From these mean measured values $\overline{m_a^s}$, the optimal mean measured value $\overline{m_a^s}$ is selected in the following operator, this optimal value generally being the mean measured value $\overline{m_a^s}$ having the lowest degree of contamination, i.e. the largest mean measured value $\overline{m_a^s}$. This optimal mean measured value $\overline{m^{as}}$ is the reference value for the turbidity measurement in the preferably following wash program. In addition to the criterion of the lowest degree of contamination, other criteria can also be used, e.g. only possible reference values from a specific column, wherein these criteria can also be predefined ex works and/or can be automatically adapted.

Figure 4:
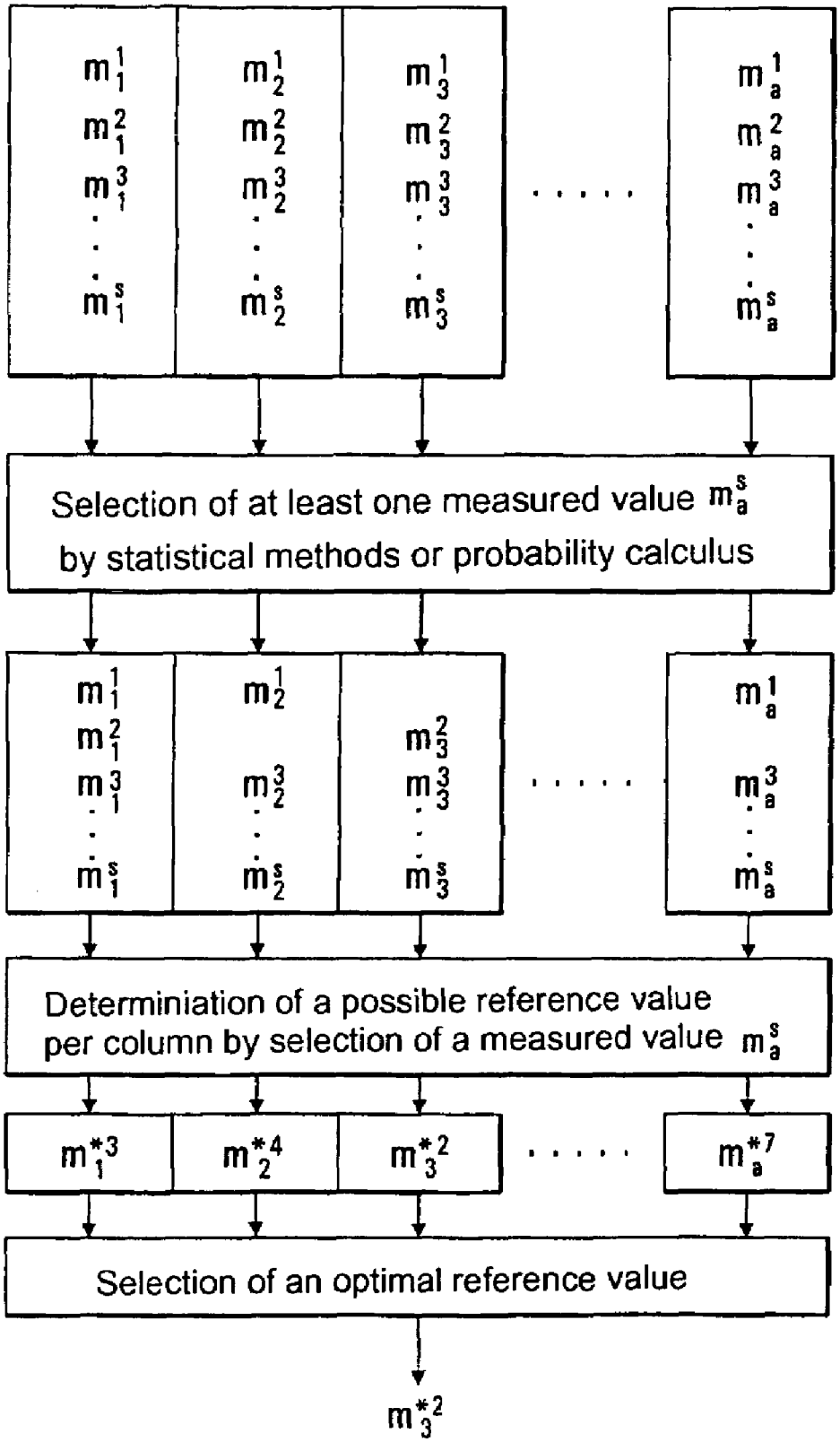

Alternatively to this procedure, in accordance with FIG. 4 in this operation unit, from the selected measured values $m_a^s$, a single measured value $m^*_a{}^s$ can be selected from each column of measured values $m_a^s$ for each $t_a$, i.e. column, by selection methods, e.g. using statistical methods, error, theory or probability calculus. From these measured values $m^*_a{}^s$ the optimal measured value $m^*_a{}^s$ is then selected as a possible reference value in the following operator, this optimal value generally being the measured value $m^*_a{}^s$ having the lowest degree of contamination, i.e. the highest measured value $m^*_a{}^s$. This optimal measured value $m^*_a{}^s$ is the reference value for the turbidity measurement in the preferably following wash program.

A statistical method for selecting at least one measured value $m_a^s$ corresponding to the uppermost operation unit in FIG. 3 and FIG. 4 is described hereinafter:

The measured values $m_a^s$ represent a number series $m_1{}^1$, $m_1{}^2, m_1{}^3, m_1{}^4, m_1{}^5, \ldots, m_1{}^s$ for wash program sequences s for measured values at a time $t_a$. From these measured values $m_a^s$, the arithmetic mean $d_1$ to $d_a$ is determined for measured values $m_a^s$ at the times $t_1$ to $t_a$ where s is the number of measured values $m_a^s$ at a time $t_a$ $$d_a = \frac{m_a^1 + m_a^2 + m_a^3 + m_a^4 + \ldots + m_a^s}{s}$$

The mean square error $\sigma_a{}^2$ is the determined for a=1, 2 to a.

$$\sigma_a^2 = \frac{(m_1^1 - d_a)^2 + (m_1^2 - d_a)^2 + \ldots + (m_1^s - d_a)^2}{s}$$

The probable limits of the reference value $m^*_a{}^s$ or $\overline{m_a^s}$ are according to the laws of error theory $$d_a \pm \frac{0{,}6746}{\sqrt{s}}$$

It is then checked in an algorithm whether measured values $m_a^s$ lie outside these probable limits. If measured values $m_a^s$ lie outside, these are selected. If the number of measured values $m_a^s$ lying outside is too large compared with the number of measured values $m_a^s$, only those measured values $m_a^s$ which lie outside the probable limit by a particular value can be excluded. If no measured values $m_a^s$ lie outside the probable limit, measured values $m_a^s$ which lie inside the probable limits by a particular value should be excluded. Values determined empirically ex works can be predefined for this purpose, these preferably being adapted arithmetically to the changing relationships in the method sequence.

This procedure is carried out for all series of measured values $m_a^s$ at the respective times $t_a$.

Instead of the mean values $d_a$, it is also possible to determine the probabilities of the individual measured values $m_a^s$ by probability calculus and to select that or those measured values $m_a^s$ having the lowest or the smallest probability, see FIG. 4.

A method of probability calculus is described hereinafter for selecting a measured value $m_a^s$ according to the second operation unit from the top according to FIG. 4 for use as a reference value for calibrating a turbidity sensor from a series of measured values $m_a^s$ e.g. $m_1{}^1, m_1{}^2, m_1{}^3, m_1{}^4, m_1{}^5, \ldots, m_1{}^s$ for wash program sequences s.

According to the Gaussian hypothesis of the arithmetic mean, the probability density for the arithmetic mean of the measured value $m_a^s$ is highest regardless of how the Gaussian error law is conditioned.

The arithmetic mean d' is determined from the remaining measured values $m_a^s$ after selecting at least one measured value $m_a^s$. The distance between the individual measured values $m_a^s$ and this arithmetic mean $d'_a$ should then be determined with $d'_1, d'_2, \ldots d'_a$, i.e. the magnitude $|d'_a - m_a^s|$. The smallest value is selected from these number series using an algorithm The measured value $m_a^s$ pertaining to this lowest value is used as a possible reference value for calibrating the turbidity sensor.

In another variant of the method according to the invention, the measured values $m_a^s$ before selecting the at least one measured value $m_a^s$ in the uppermost operation unit can be selected as an initial basis for this selection of a measured value $m_a^s$ for use as a reference value. The uppermost operation unit in FIG. 4 is thus not used.

The most optimum reference values, which generally corresponds to the reference values with the lowest degree of contamination is then selected from these possible reference values $m^*_a{}^s$ whose number a corresponds to the number a of times $t_a$ for measurement of the measured values $m_a^s$ within the wash program sequence s. This is accomplished using a corresponding algorithm to determine the highest value.

Unlike this procedure, the probability density can be determined for each measured value $m_a^s$ using the laws of probability calculus and that measured value having the highest probability density can be selected as the reference value. The intermediate or final values determined in this procedure are preferably buffered in non-volatile memories. The control is carried out using a corresponding computer system.

Household appliances suitable for carrying out a method according to the invention and computer programs and computer program products for carrying out the method are also part of the invention.

By selecting individual measured values by statistical methods, the present method according to the invention for calibrating sensors in household appliances can be used to minimise errors resulting from the use of measured values with large deviations, e.g. caused by temporary impurities, within a measurement series to determine the reference value. Individual measured values with large deviations are selected in particular by statistical methods.

Compared with averaging, the selection of an individual measured value as reference value, in particular using methods of probability calculus, can prevent the error produced by measured values having particularly strong deviations, caused by incorrect measurements e.g. when deposits are briefly present on the receiving or transmitting devices.

The invention claimed is:

1. A method for calibrating a turbidity sensor in a domestic appliance, with the aid of reference values comprising the following steps:

determining a plurality of measured values in at least one cleaning program sequence executed by a computer, the cleaning program sequence having a plurality of sequential time positions at which measured values can be determined, the plurality of measured values including at least two measured values being from the same time position within the program sequence;

calculating, using a program executed by the computer, at least one measured value by at least one of statistical methods and probability calculus for omission from the following step;

determining at least one possible reference value for calibrating the sensor from the non-selected measured values; and selecting an optimal reference value from the least one possible reference value if more than two possible reference values have been determined.

2. The method according to claim 1, wherein the selection of the at least one measured value by at least one of statistical methods and probability calculus which is no longer taken into account in the following step is made in each case from a series of measured values which are measured at the same times within a at least one washing program sequence executed by the computer.

3. The method according to claim 1, wherein the following steps are carried out for selecting at least one measured value ($m_a^s$):

determining the arithmetic mean ($d_1$ to $d_a$) for the measured values ($m_a^s$ for a=1, 2, . . . a) according to the formula $$d_a = \frac{m_a^1 + m_a^2 + m_a^3 + m_a^4 + \ldots + m_a^s}{s},$$

determining the mean square error ($\sigma_a^2$ for $\sigma_1^2$ to $\sigma_a^2$) with $d_a$ from the first step using the formula $$\sigma_a^2 = \frac{(m_1^1 - d_a)^2 + (m_1^2 - d_a)^2 + \ldots + (m_1^s - d_a)^2}{s},$$

determining the probable limits of the possible reference value ($m^*_a{}^s$, $\overline{m_a^s}$ for $m^*_1{}^s$, $\overline{m_a^s}$ to $m^*_a{}^s$, $\overline{m_a^s}$) wherein these lie within $$d_a \pm \frac{0{,}6746}{\sqrt{s}}$$

and selecting the measured values ($m_a^s$) which lie outside these limits.

4. The method according to claim 3, wherein if no measured value ($m_a^s$) lies outside the probable limits of the possible reference value ($m^*_a{}^s$, $\overline{m_a^s}$) the interval of the probable limits of the possible reference value ($m^*_a{}^s$, $\overline{m_a^s}$) is set as smaller so that at least one measured value ($m_a^s$) lies outside and this at least one measured value ($m_a^s$) is selected.

5. The method according to claim 4, wherein empirical values are additionally used to determine the probable limits of the possible reference value ($m^*_a{}^s$, $\overline{m_a^s}$), the empirical values being automatically adapted to changing relationships in the process sequence.

6. The method according to claim 1, wherein the at least one possible reference value ($\overline{m_a^s}$) for the calibration of the sensor is determined from the remaining non-selected measured values ($m_a^s$) by averaging performed by the computer.

7. The method according to claim 1, wherein the at least one possible reference value ($m^*_a{}^s$) for the calibration of the sensor is determined from the remaining non-selected measured values ($m_a^s$) by selecting a measured value ($m_a^s$) by means of at least one of statistical methods and probability calculus performed by the computer.

8. The method according to claim 7, wherein the measured value ($m_a^s$) with the highest probability density within the non-selected measured values ($m_a^s$) is selected.

9. The method according to claim 7, wherein that measured value ($m_a^s$) is selected as a possible reference value ($m^*_a{}^s$) that lies closest to the arithmetic mean of the non-selected measured value $m_a^s$ by the following steps:

determine the arithmetic mean ($d'_a$ for a=1, 2, a) of the non-selected measured values ($m_a^s$)

determining the magnitude of $|d'_a - m_a^s|$, wherein that measured value ($m_a^s$) is selected for which the magnitude of $|d'_a - m_a^s|$ is smallest.

10. The method according to claim 1, wherein from the possible reference values ($\overline{m_a^s}$, $m^*_a{}^s$) the most optimum is selected as the reference value ($\overline{m_a^s}$, $m^*_a{}^s$) for the calibration of the sensor, which can include a reference value ($\overline{m_a^s}$, $m^*_a{}^s$) having the lowest degree of contamination.

11. A domestic appliance in which a method according to claim 1, can be implemented.

12. A computer program embodied on a computer-readable medium with program code means executed by said computer to carry out all the steps of a method according to claim 1, if the computer program is carried out on said computer-readable medium or a corresponding processing unit.

13. A computer program product stored on a computer-readable data carrier with program code means executed by said computer-readable data carrier to carry out all the steps of a method according to claim 1, if the computer program is carried out said computer-readable data carrier or a corresponding processing unit.

14. A method for calibrating a turbidity sensor in a domestic appliance, with the aid of reference values comprising the following steps:

determining at least two measured values in at least one cleaning program sequence executed by a computer, the cleaning program sequence having a plurality of sequential time positions at which measured values can be determined, the plurality of measured values including at least two measured values being from the same time position within the program sequence;

determining at least one possible reference value from the measured values by selecting a measured value using methods of at least one of probability calculus and statistics executed by the computer; and selecting an optimal reference value from the possible reference values if more than one possible reference value has been determined.

15. The method according to claim 14, wherein the selection of the at least one measured value ($m_a^s$) is made by at least one of statistical methods and probability calculus executed by a computer in each case from a series of measured values which were measured at the same times ($t_a$) within at least one washing program sequence executed by the computer.

16. The method according to claim 15, wherein from the reference values ($m^*_a{}^s$) the most optimum is selected as the reference value ($m^*_a{}^s$) for the calibration of the sensor, which can include a reference value ($m^*_a{}^s$) having the lowest degree of contamination.

17. The method according to claim 14, wherein that measured value ($m_a^s$) is selected as a reference value ($m^*_a{}^s$) that lies closest to the arithmetic mean of the non-selected measured values $m_a^s$ by the following steps:

determine the arithmetic mean ($d'_a$ for a=1, 2, a) of the non-selected measured values ($m_a^s$); and determining the magnitude of $|d'_a - m_a^s|$, wherein that measured value $m_a^s$ is selected for which the magnitude of $|d'_a - m_a^s|$ is smallest.

* * * * *